US008470229B2

(12) United States Patent
Nasvik et al.

(10) Patent No.: US 8,470,229 B2
(45) Date of Patent: Jun. 25, 2013

(54) IMPRINTING PATTERN MAT

(76) Inventors: Jonathan Nasvik, Hailey, ID (US); Paul C. Nasvik, Hudson, WI (US)

( * ) Notice: Subject to any disclaimer, the term of this patent is extended or adjusted under 35 U.S.C. 154(b) by 1452 days.

(21) Appl. No.: 11/655,014

(22) Filed: Jan. 18, 2007

(65) Prior Publication Data

US 2008/0173787 A1 Jul. 24, 2008

(51) Int. Cl.
*B28B 11/10* (2006.01)

(52) U.S. Cl.
USPC ..... 264/293; 264/33; 264/34; 264/333; 264/294; 249/187.1; 249/188; 249/189; 404/75; 404/89; 404/93; 425/63; 425/64; 425/65; 425/458

(58) Field of Classification Search
USPC ..... 404/89, 93, 75; 264/294, 293, 333, 264/33, 34; 425/458, 63, 64, 65; 249/187.1, 249/188, 189
See application file for complete search history.

(56) References Cited

U.S. PATENT DOCUMENTS

| | | | |
|---|---|---|---|
| 3,887,293 | A | 6/1975 | Bowman |
| 3,930,740 | A | 1/1976 | Bowman |
| 4,135,840 | A | 1/1979 | Puccini et al. |
| D282,623 | S | 2/1986 | Nasvik |
| 4,776,723 | A | 10/1988 | Brimo |
| 5,487,656 | A | 1/1996 | Kaitanjian |
| 6,595,768 | B1 | 7/2003 | Hunsaker |

OTHER PUBLICATIONS

Anne Balogh, Guide to Buying Stamps and Skins, Dec. 28, 2005, http://www.concretesherpa.com/pdf/stampsandskins, pp. 1-13.*
"Ideal Imprints: Step into a whole new world", brochure for Ideal Imprints Incorporated of Hudson, Wisconsin.

* cited by examiner

*Primary Examiner* — Katarzyna Wyrozebski Lee
*Assistant Examiner* — Joshel Rivera
(74) *Attorney, Agent, or Firm* — Kinney & Lange, P.A.

(57) ABSTRACT

A mat for creating patterns in concrete includes a center portion, a feathered border surrounding the center portion, a top surface, and a bottom surface. A design stamp is positioned in the center portion of the bottom surface.

16 Claims, 9 Drawing Sheets

IMPRINTING PATTERN MAT

BACKGROUND OF THE INVENTION

The present invention relates generally to the field of concrete stamping. In particular, the present invention relates to an imprinting pattern mat.

Flooring can be constructed from a single uniform building material such as concrete, or from unique individual building materials such as natural stones or bricks that are bonded together with an adhesive substance, such as mortar. When the flooring is formed from a uniform building material, the surface of the flooring will typically have a smooth surface. By contrast, when the flooring is formed by arranging individual building materials relative to each other and maintaining them in place with an adhesive substance, the surface of the flooring can have a random or textured pattern, which may be more pleasing to the eye.

Although flooring comprised of individual building materials may be desirable, building such flooring is not always a practical option. Constructing flooring made of stone or brick causes structural concerns and is often intensive and requires highly skilled laborers. Specialized equipment and tools may also be required. In addition, the cost of the materials themselves are high, and the cost of the labor involved is likewise high.

A less costly alternative to constructing flooring from individual building materials is to construct flooring using a moldable building material, such as concrete. Using concrete, a simulated stone or brick flooring can be created such that the surface of the flooring looks as though it was built using individual building materials. This can be accomplished by utilizing a system of stamps positioned on the concrete when the concrete is wet. The stamps are created with an inverted texture or impression. The stamps are positioned on the concrete after the concrete is poured and allowed to slightly harden. After the texture or impression of the stamps has been imprinted in the concrete, the stamps are removed and the concrete material hardens to reveal a simulated stone or brick flooring.

Concrete is a particularly suitable material for building simulated stone or brick flooring because it results in a more realistic texture and feel. However, problems are frequently encountered when a stamp is repeated in a continuous structure. The first problem arises due to the manner in which the stamps are arranged next to each other. When individual stamps having generally linear sides are positioned adjacent to one another, it may become possible for the human eye to identify the joint created by the stamps in the finished work. This is particularly true when the shape of the stamp is a simple shape, such as a rectangle. The second problem is the easily recognized repetitiveness from these same stamps being used over and over again on one surface.

Performing a successful simulated stone or brick flooring typically requires quite skillful and experienced installers using several stamps (tools) to create the texture or pattern because of inherent problems due to the design nature of the stamps. Stamps are typically cast at least half of an inch thick with rigid urethane material. Weight restrictions ultimately limit the size of both the stamp and the pattern. Also, because the stamps must fit tightly alongside one another to produce a complete pattern, alignment becomes critical as the stamps are moved and positioned across the concrete. As the installer tamps the stamps into the concrete, the stamps tend to shift, slowing the installation process by producing uneven spacing and formations of excess concrete between the stamps. Due to the size and positioning of the stamps, the concrete may shift and create excess mounds of concrete between the stamps as the textures or imprints are being stamped into the concrete or as the stamps are lifted from the concrete. Rigid tools may also cause unevenness between the stamps because the tamping process is not uniform and one stamp may get driven further into the concrete than a stamp positioned adjacent to it, causing "steps" or "trippers" throughout the completed work. The rigidity of the tools also makes it difficult to deal with obstacles such as walls or other permanent structures that stand up in the installation area. In tight spaces where the rigid tools cannot fit, hand stamping is required, which is a free-hand attempt to match the carefully defined appearance set down by the stamping tool, often resulting in an obvious difference in the finished pattern.

Depending on the size of an installation, a large number of stamps may be needed, driving up the cost and ultimately slowing down the imprinting process. Stamping is also a time-intensive process due to the hardening nature of concrete. Thus, although the concrete may imprint well in the beginning, the sluggish movement of stamping tools can fall behind the hardening of the concrete, rendering poor results at the final end of the installation. This will make the flooring more obviously simulated.

In recent years, an attempt to alleviate these problems by using a flexible texture mat, or seamless mat, has met with reasonable success and has become quite popular. The texture mats imprint only texture, without a pattern, onto the concrete. Once the concrete hardens, simple patterns are scored into the concrete with power saw cutting equipment. However, this process still requires skilled laborers and extensive amounts of time to create textured flooring with patterns. Although attractive, the patterns have limited diversity with regard to the final appearance of the concrete.

BRIEF SUMMARY OF THE INVENTION

A mat for creating patterns in concrete includes a center portion, a feathered border surrounding the center portion, a top surface, and a bottom surface. A design stamp is positioned in the center portion of the bottom surface.

DETAILED DESCRIPTION

Figure 1:
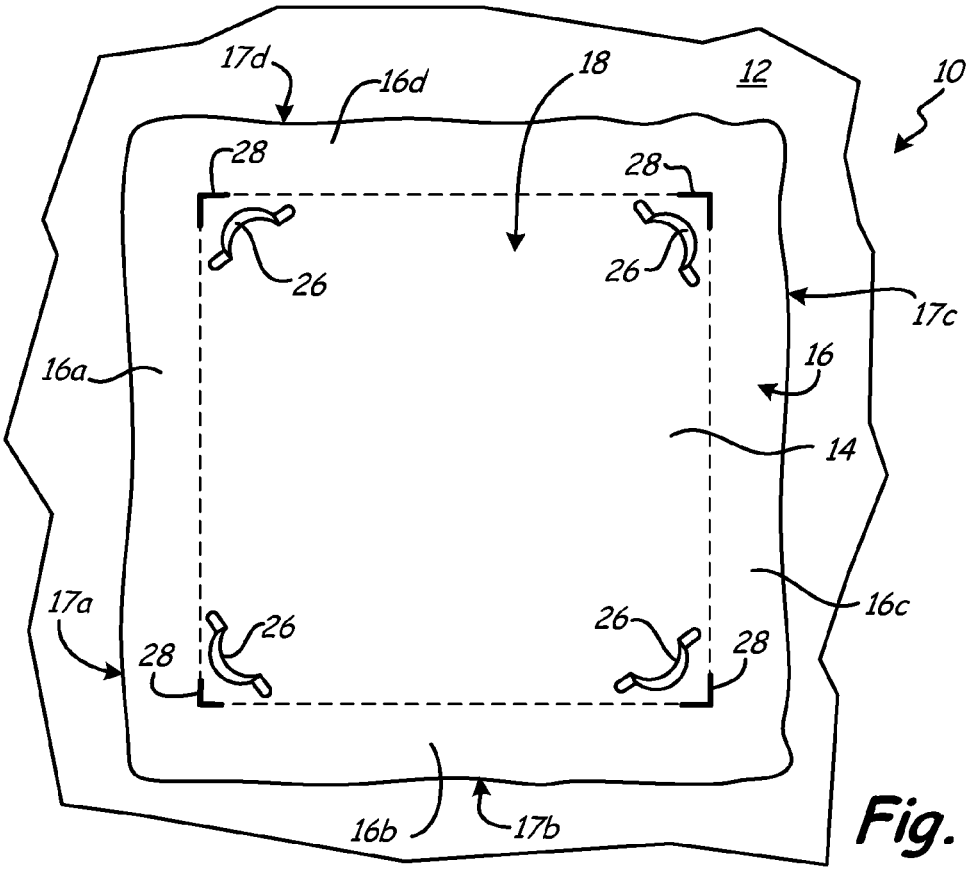
FIG. 1 is a top view of an imprint pattern mat.

FIG. 1 shows a top view of a representative imprint pattern mat 10 for imprinting a pattern into cement or concrete 12.

Figure 2:
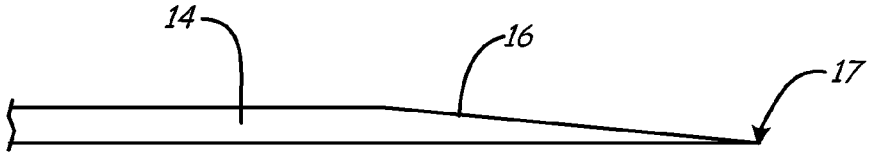
FIG. 2 shows a cross-sectional view of the imprint pattern mat.

FIG. 2 shows a cross-sectional view of imprint pattern mat 10 and will be discussed in conjunction with FIG. 1. Imprint pattern mat 10 includes center portion 14, feathered border 16, top surface 18, and bottom surface 20 (shown in FIG. 3). Bottom surface 20 of imprint pattern mat 10 includes texture 22 and design stamp 24 (shown in FIG. 3) positioned at center portion 14, combining two different imprinting tools, a texture mat and a pattern mat. Imprint pattern mat 10 allows quick and easy installation of patterned concrete and requires minimal skill. Design stamp 24 of imprint pattern mat 10 increases the flexibility of patterns that can be created in concrete 12. Depending on design stamp 24, concrete 12 may have a finalized pattern that can be either random or symmetrical. In addition, imprint pattern mat 10 eliminates potentially costly mistakes and inherent flaws caused by traditional patterned imprinting tools.

Imprint pattern mat 10 is typically formed of a pliable and flexible material that is lightweight and easy to handle. In an exemplary embodiment, imprint pattern mat 10 is formed at least in part of polyurea and is approximately 0.25 inches thick. Top surface 18 of imprint pattern mat 10 includes handles 26 and alignment marks 28. Handles 26 are positioned on top surface 18 to facilitate handling of imprint pattern mat 10. Due to the lightweight structure of imprint pattern mat 10, imprint pattern mat 10 can be easily lifted by a single person using handles 26. Top surface 18 of imprint pattern mat 10 also includes alignment marks 28 proximate feathered border 16 that function to assist a user in positioning adjacent imprint pattern mats 10. Although FIG. 1 shows alignment marks 28 as two lines arranged perpendicular to one another at corners of center portion 14, alignment marks 28 may take any form or shape without departing from the intended scope of the present invention as long as alignment marks 28 allow alignment of adjacent imprint pattern mats 10. In an exemplary embodiment, imprint pattern mat 10 is has a substantially geometric shape with dimensions of between approximately 3.5 feet by approximately 3.5 feet and between approximately 6 feet by approximately 6 feet.

Center portion 14 is surrounded by first feathered edge 16*a*, second feathered edge 16*b*, third feathered edge 16*c*, and fourth feathered edge 16*d*, collectively referred to as feathered border 16. Feathered border 16 allows adjacent imprint pattern mats 10 to overlap each other without creating unintentional lines or designs in concrete 12. Feathered edges 16*a*-16*d* are less dense than center portion 14 and taper from center portion 14 to outer edges 17*a*-17*d* of feathered edges 16*a*-16*d*, respectively. In an exemplary embodiment, feathered edges are approximately 0.25 inches thick at center portion 14 and taper to 0 inches at outer edges 17*a*-17*d*. The tapers of feathered edges 16*a*-17*d* allow imprint pattern mat 10 to be stamped into wet concrete 12 without creating unsightly concrete 12 that has been displaced by the weight and form of imprint pattern mat 10. In an exemplary embodiment, each of feathered edges 16*a*-16*d* extends approximately three inches from center portion 14.

Figure 3:
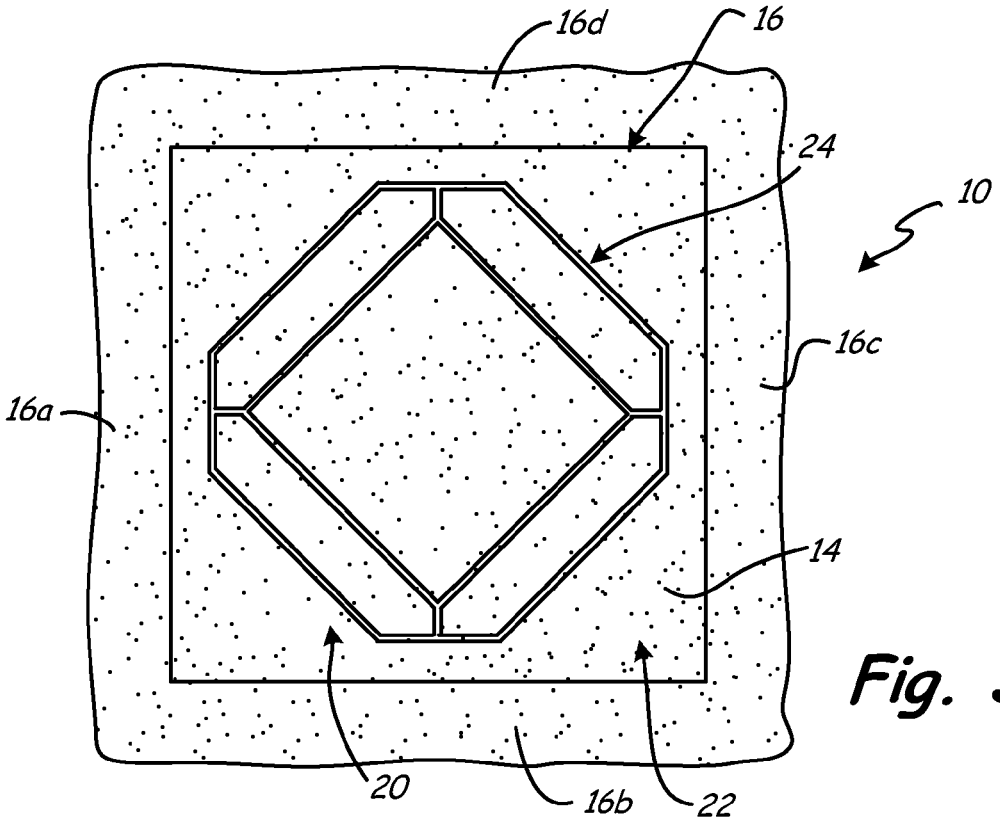
FIG. 3 is a bottom view of a representative imprint pattern mat.

FIG. 3 shows a bottom view of representative imprint pattern mat 10. Bottom surface 20 of imprint pattern mat 10 is textured 22 to create an aesthetic appearance in concrete 12. Texture 22 extends from center portion 14 through feathered border 16 of bottom surface 20. Design stamp 24 is positioned within center portion 14 of bottom surface 20 and protrudes from bottom surface 20 such that design stamp 24 is engagable with concrete 12. Although FIG. 3 depicts design stamp 24 as having a particular shape, design stamp 24 may take on any symmetrical or asymmetrical shape without departing from the intended scope of the present invention.

In an exemplary embodiment, imprint pattern mat 10 is formed substantially of polyurea. The polyurea is a two-part material that is sprayed onto a mold using a spray gun. The spray gun mixes and heats the material up to approximately 140 degrees Fahrenheit and pumps it at high pressure. The polyurea is sprayed from the spray gun such that center portion 14 is more dense than feathered border 16. After the polyurea is sprayed from the spray gun, the polyurea is allowed to dry for approximately 5 minutes before use. In an alternative embodiment, imprint pattern mat 10 may be formed by measuring out a discrete amount of polyurea and mixing for approximately two minutes. The polyurea is then poured out onto a mold to form center portion 14 while thinning the material out to form feathered border 16. Design stamp 24 is also formed in a similar manner. In an exemplary embodiment, a design is formed from thin pieces of masonry such as stone, brick, tile, or other man-made material configured and dimensioned into the desired design.

Figure 4A:
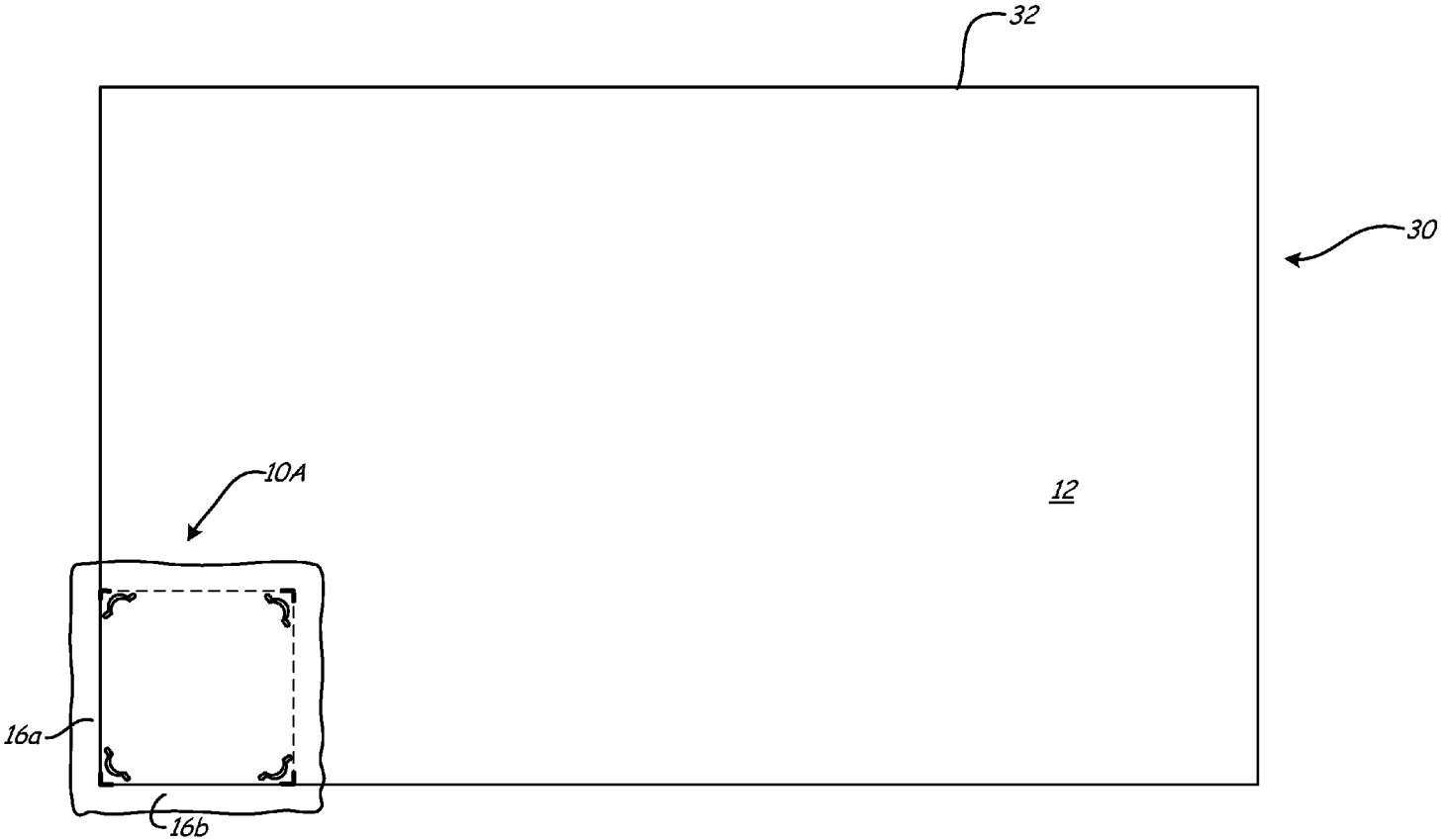
FIG. 4A is a schematic view of a first step of a system for creating a pattern using the imprint pattern mat.

FIGS. 4A-4D show sequential steps of a system 30 for creating a pattern in concrete 12 using first imprint pattern mat 10A, second imprint pattern mat 10B, third imprint pattern mat 10C, fourth imprint pattern mat 10D, fifth imprint pattern mat 10E, and sixth imprint pattern mat 10F. FIG. 4A shows a schematic view of a first step of system 30. After concrete 12 is poured over the desired area to be patterned 32, concrete 12 is allowed to harden for a short period of time. In an exemplary embodiment, concrete 12 is allowed to harden for between approximately 20 minutes and approximately 40 minutes. However, the amount of time that concrete 12 is allowed to harden will depend on a variety of factors, including, but not limited to: how old the concrete is, what the outside temperature is, what type of concrete is being used, whether the concrete is being poured in the sun or the shade, whether the weather is dry or humid, and what type of soil is the concrete being poured on. All of these factors must be taken into account when determining the proper amount of time to wait before beginning the stamping process. Once concrete 12 has been allowed to harden, first imprint pattern mat 10A is positioned on concrete 12. Typically, adjacent edges 16*a* and 16*b* of first imprint pattern mat 10A are aligned with an edge of the area to be patterned 32.

Figure 4B:
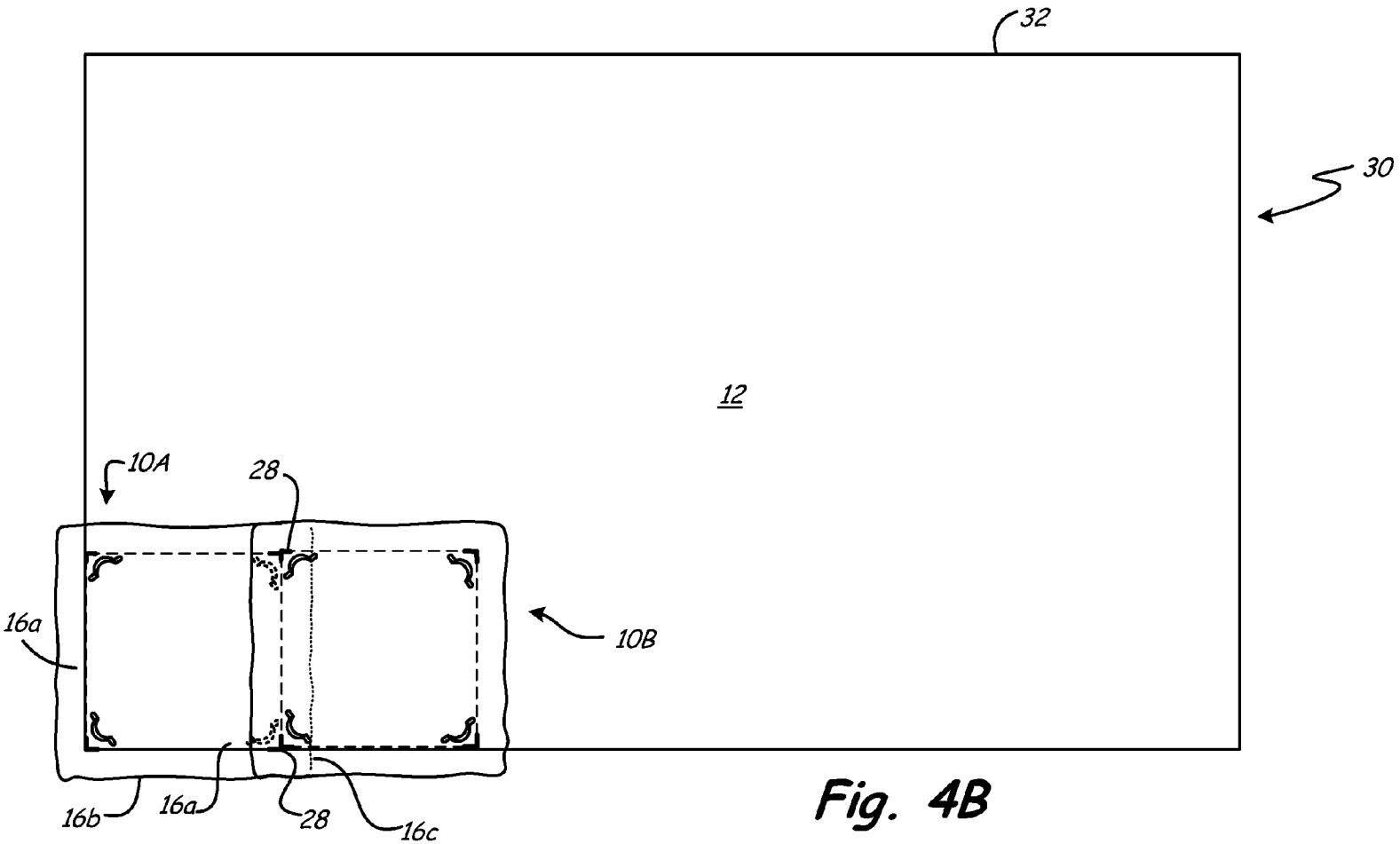
FIG. 4B is a schematic view of a second step of the system for creating a pattern using the imprint pattern mat.

FIG. 4B shows a schematic view of a second step of system 32. While first imprint pattern mat 10A is still positioned over concrete 12, second imprint pattern mat 10B is aligned with first imprint pattern mat 10A using alignment marks 28 on top surfaces 18 of first imprint pattern mat 10A and second pattern mat 10B. Using alignment marks 28, second imprint pattern mat 10B is placed on concrete 12 adjacent first imprint pattern mat 10A such that alignment marks 28 proximate third feathered edge 16*c* of first imprint pattern mat 10A and alignment marks 28 proximate first feathered edge 16*a* of second imprint pattern mat 10B align with each other. Thus, when second imprint pattern mat 10B is properly positioned with respect to first imprint pattern mat 10A, center portion 14 of first imprint pattern mat 10A abuts center portion 14 of second imprint pattern mat 10B. First feathered edge 16*a* of second imprint pattern mat 10B overlaps a part of center portion 14 of first imprint pattern mat 10A and a part of center portion 14 of second imprint pattern mat 10B overlaps third feathered edge 16*c* of first imprint pattern mat 10A.

Figure 4C:
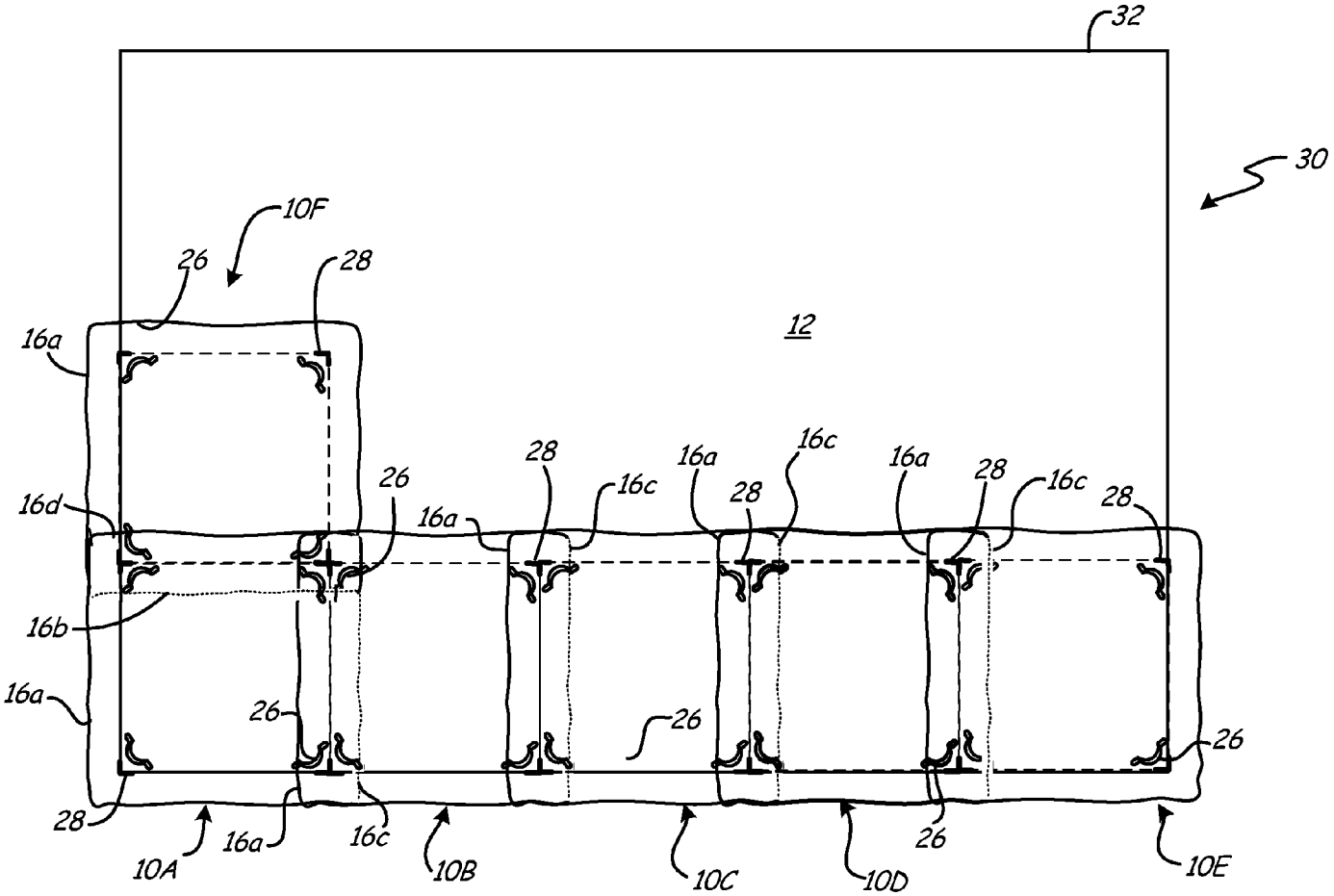
FIG. 4C is a schematic view of an $n^{th}$ step of the system for creating a pattern using the imprint pattern mat.

FIG. 4C shows a schematic view of an $n^{th}$ step of system 30. First, second, third, fourth, and fifth imprint pattern mats 10A-10E are first positioned adjacent one another as described above until a length of the area to be patterned 32 is covered. Thus, in the exemplary embodiment shown in FIGS. 4A-4C, alignment marks 28 proximate first feathered edge 16*a* of third imprint pattern mat 10C are aligned with alignment marks 28 proximate third feathered edge 16*c* of second imprint pattern mat 10B, alignment marks 28 proximate first feathered edge 16*a* of fourth imprint pattern mat 10D are aligned with alignment marks 28 proximate third feathered edge 16*c* of third imprint pattern mat 10C, and alignment marks 28 proximate first feathered edge 16*a* of fifth imprint pattern mat 10E are aligned with alignment marks 28 proximate third feathered edge 16*c* of fourth imprint pattern mat 10D. After a length of the area to be patterned 32 has been covered with first, second, third, fourth, and fifth imprint pattern mats 10A-10E, sixth imprint pattern mat 10F is positioned adjacent first imprint pattern mat 10A such that alignment marks 28 proximate fourth feathered edge 16*d* of sixth imprint pattern mat 10F are aligned with alignment marks 28 proximate second feathered edge 16*b* of first imprint pattern mat 10A. Although FIG. 4C depicts and is discussed as positioning sixth imprint pattern mat 10F adjacent first imprint pattern mat 10A, sixth imprint pattern mat 10F may be positioned adjacent any of imprint pattern mats 10A-10E already positioned on concrete 12.

Once imprint pattern mats 10A-10F have been positioned on concrete 12 of the area to be patterned 32, a stamping tool, such as a tamper, is used to transfer design stamp 24 of each of imprint pattern mats 10A-10F into concrete 12. Prior to using the stamping tool, a snow-shoe type tool (foot floats) may also be attached to the feet of the installer for early access to imprinting softer concrete. As the stamping tool taps imprint pattern mats 10A-10F into concrete 12, texture 22 and design stamp 24 (shown in FIG. 3) of imprint pattern mats 10A-10F are pushed into concrete 12, forming an imprint 34 (shown in FIG. 4D) of texture 22 and design stamp 24 into concrete 12. Due to the dimensions of each of imprint pattern mats 10 and the stamping tool used, substantially any amount of weight may be pressed atop imprint pattern mats 10A-10F without detrimentally causing excess shifting of concrete 12 beneath imprint pattern mats 10A-10F due to displacement of concrete 12 by design stamps 24. Typically, the stamping step occurs as soon as the user can step onto concrete 12 without leaving a footprint. In an exemplary embodiment, each of imprint pattern mats 10A-10F are stamped into concrete 12 for between approximately 1 minute and approximately 3 minutes.

After textures 22 and design stamps 24 of imprint pattern mats 10A-10F are stamped into concrete 12, imprint pattern mats 10A-10F are removed from concrete 12 using handles 26. Design stamps 24 and textures 22 of bottom surfaces 20 imprint pattern mats 10A-20F leave imprints 34A, 34B, 34C, 34D, 34E, and 34F, respectively, in concrete 12 to form a pattern (shown in FIG. 4D). If more area is still left to be patterned, imprint pattern mats 10A-10F may be reused in the same manner as discussed above in the discussions of FIGS. 4A-4C until the entire area to be patterned 32 is covered. In addition, because imprint pattern mats 10A-10F are flexible, they fold up easily against permanent features such as walls, eliminating difficulties associated with using handstamps to complete a pattern proximate immovable structures. Although FIG. 4C depicts using six imprint pattern mats 10A-10F, any number of imprint pattern mats 10 may be used without departing from the intended scope of the present invention. The number of imprint pattern mats 10 needed may depend on factors including, but not limited to: the dimensions of each of imprint pattern mats 10, the dimensions of the area to be patterned 32, and the number of individual imprint pattern mats 10 available for use.

Figure 4D:
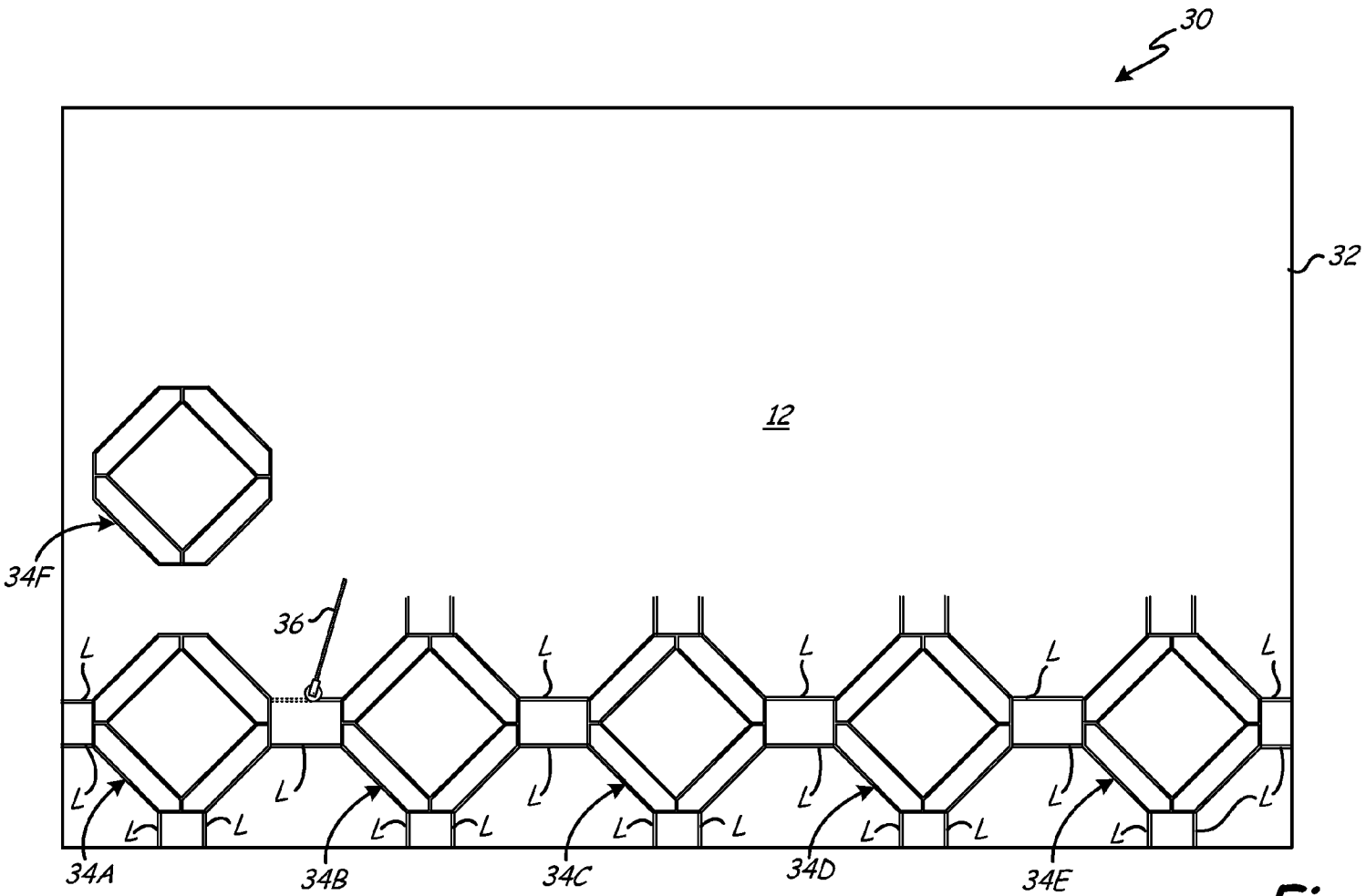
FIG. 4D is a schematic view of a final step of the system for creating a pattern using the imprint pattern mat.

FIG. 4D shows a schematic view of an optional final step of system 30 for creating a pattern using imprint pattern mats 10. Once imprint pattern mats 10A-10F (shown in FIG. 4C) have been removed from concrete 12 to leave imprints 34A-34F, a joint roller 36 may be used to complete the pattern created in concrete 12 by design stamps 24 (shown in FIG. 3) of imprint pattern mats 10A-10F. Joint roller 36 is used to create lines L connecting imprints 34A-34F left by each of imprint pattern mats 10A-10F (shown in FIG. 4C). Design stamp 24 is typically designed with some randomness to facilitate the ease of completion of a pattern using lines L created by joint roller 36. Depending on the lines L created using joint roller 36, the resulting overall pattern in concrete 12 may be symmetrical or asymmetrical. Thus, the pattern in concrete 12 may either be substantially repeated or random (unique) and difficult to replicate, depending on the intention of the user. Joint roller 36 may also optionally not be used in system 30, depending on the design stamps 24 on bottom surfaces 20 (shown in FIG. 3) of imprint pattern mats 10A-10F and the desired resulting pattern. Although lines L are discussed as being created by joint roller 36, lines L may be formed in concrete 12 be any tool known in the art, including, but not limited to: a hand stamp tool, such as a chisel, or a grinder, such as a power grinder with a diamond blade. The tool used to create L may depend on the hardness of the cement and the particular shape of L desired. It should be noted that although FIG. 4D depicts imprints 32A-34F as being similar in shape, design stamps 24 and resulting imprints 34A-34F of imprint pattern mats 34A-34F, respectively, may also be different without departing from the intended scope of the present invention. In addition, various coloring agents and pigments may optionally be added or dusted onto concrete 12 in order to enhance the overall aesthetic appearance or to increase the level of uniqueness of concrete 12.

Figure 5:
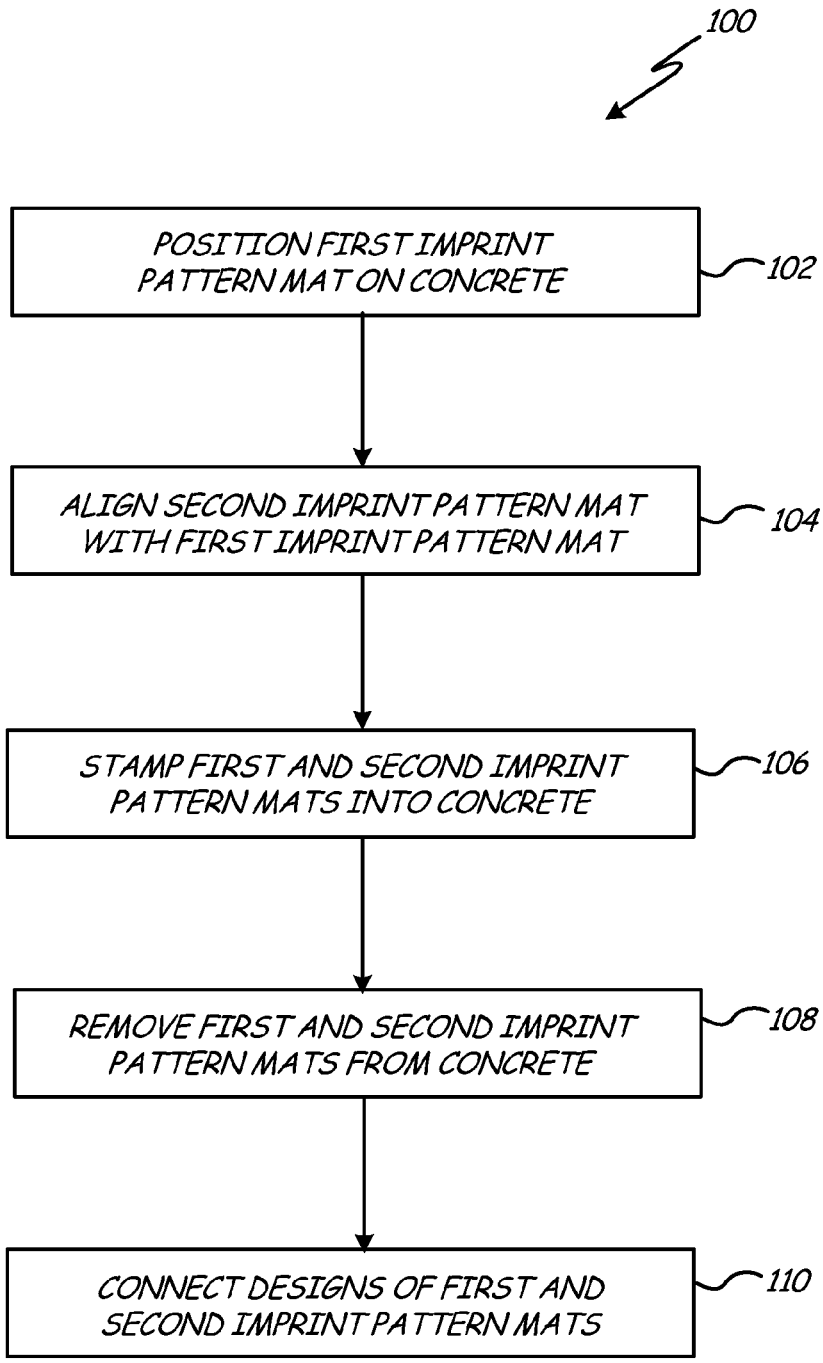
FIG. 5 is a diagram of a method for creating a pattern using an imprint pattern mat.

FIG. 5 shows a diagram of a method 100 for creating a pattern in concrete 12 using imprint pattern mats 10. First imprint pattern mat 10A is first positioned on concrete 12 in a starting position, Box 102. Second imprint pattern mat 10B is then aligned with first imprint pattern mat 10A by aligning alignment marks 28 proximate third feathered edge 16*c* on top surface 18 of second imprint pattern mat 10B with alignment marks 28 proximate first feathered edge 16*a* on top surface 18 of first pattern mat 10A, Box 104. After alignment marks 28 are aligned, center portion 14 of first imprint pattern mat 10A abuts center portion 14 of second imprint pattern mat 10B. As shown in Box 106, after first and second imprint pattern mats 10A and 10B are positioned on concrete 12, first and second imprint pattern mats 10A and 10B are stamped into concrete 12. First and second imprint pattern mats 10A and 10B are then removed from concrete 12 using handles 26, Box 108. Once first and second imprint pattern mats 10A and 10B are removed from concrete 12, forming imprints 34A and 34B in concrete 12, a plurality of lines may optionally be created using joint roller 36 to connect the designs of first and second imprint pattern mats 10A and 10B, Box 110 (optional). It should be noted that although method 100 is discussed as using first and second imprint pattern mats 10A and 10B, any number of imprint pattern mats 10 may be positioned atop concrete 12 before stamping and removing imprint pattern mats 10 from concrete 12.

Figure 6:
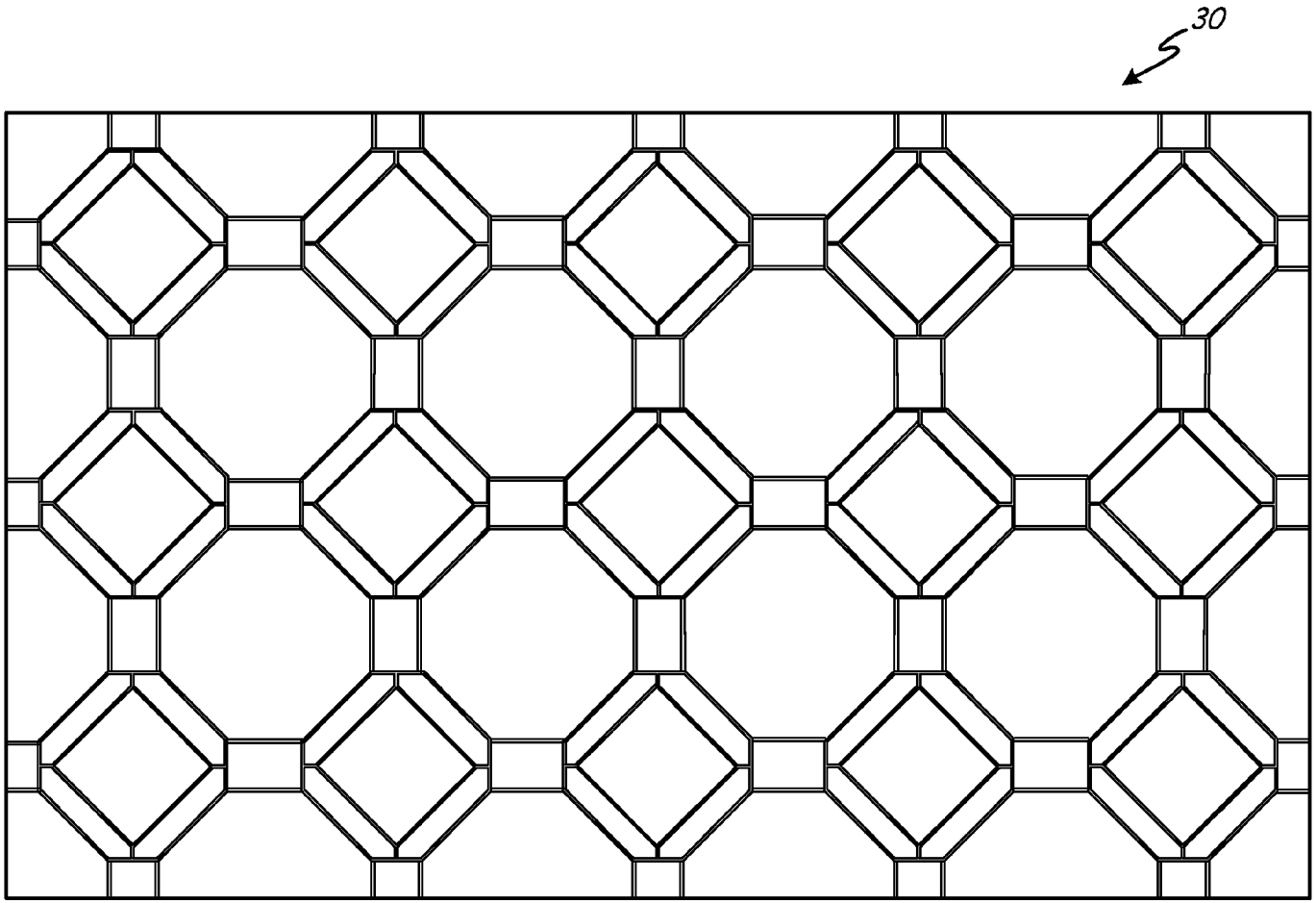
FIG. 6 is a top view of a first pattern formed by the imprint pattern mat shown in FIG. 3.

FIG. 6 shows a top view of a complete pattern 30 formed using design stamp 24 of imprint pattern mat 10 (shown in FIG. 3). Using method 100 described in the discussion of FIG. 5, pattern 30 is created using a single imprint pattern mat 10 having a single design stamp 24. By repeating the steps of method 100, a customized pattern 30 may be created in a timely and cost effective manner.

Figure 7A:
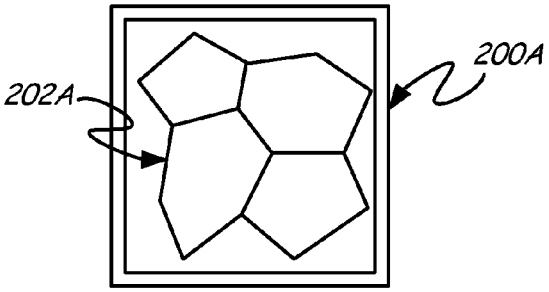
FIG. 7A is a bottom view of a first imprint pattern mat.
Figure 7B:
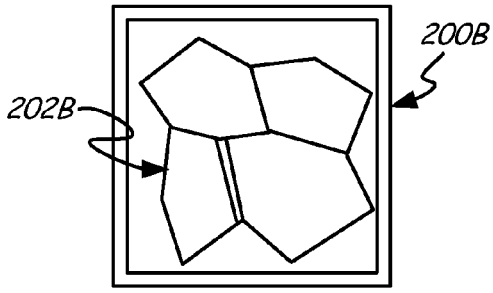
FIG. 7B is a bottom view of a second imprint pattern mat.
Figure 7C:
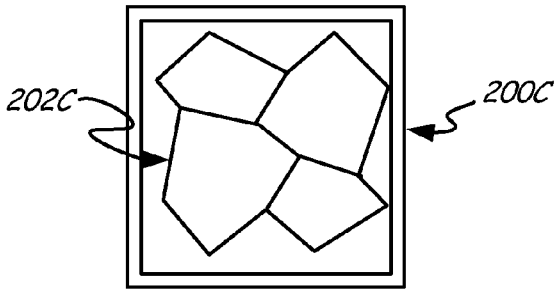
FIG. 7C is a bottom view of a third imprint pattern mat.
Figure 8:
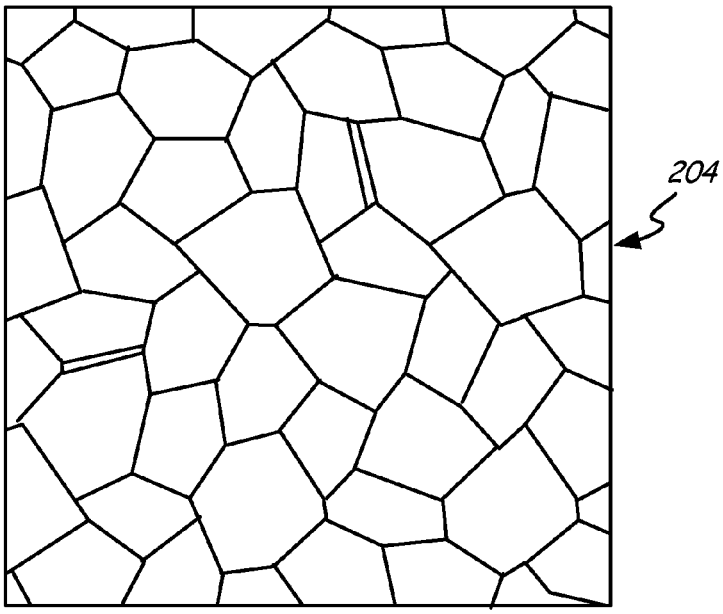
FIG. 8 is a top view of a second pattern formed by the imprint pattern mats shown in FIGS. 7A-7C.

FIGS. 7A, 7B, and 7C show bottom views of first imprint pattern mat 200A having first design stamp 202A, second imprint pattern mat 200B having second design stamp 202B, and third imprint pattern mat 200C having third design stamp 202C. FIG. 8 shows a top view of a second pattern 204 formed using imprint pattern mats 200A-200C and will be discussed in conjunction with FIGS. 7A-7C. Although pattern 30 shown in FIG. 6 was created using a single design stamp 24, if a more randomized pattern is desired, additional design stamps may be used. First, second, and third imprint pattern mats 200A-200C function in the same manner as imprint pattern mat 10, except that each of imprint pattern mats 200A-200C have differing design stamps 202A-202C, respectively. By increasing the number of design stamps used in to create a pattern, a more randomized pattern 204 may be created, as shown in FIG. 8. Thus, depending on the desired pattern, either one design stamp or multiple design stamps may be used.

The imprint pattern mat combines the attributes of flexible texture mats and rigid pattern mats into one mat to form patterns in concrete while solving numerous installation problems currently experienced in the art. The imprint pattern mat includes a center portion surrounded by feathered edges, a top surface, and a bottom surface. A number of imprint pattern mats are positioned adjacent to one another using alignment marks on the imprint pattern mats and then stamped into the concrete. The bottom surface of the imprint pattern mat has texture and a design stamp to quickly and easily create a pattern in the concrete. After the imprint pattern mats have been stamped into the concrete and removed, a plurality of imprints remain in the concrete, creating a pattern. The resulting pattern can be further enhanced by using a joint roller to create additional lines and connections between the individual imprints created by each of the imprint pattern mats. The simplicity of using a single imprint mat requires minimal skill and manpower to create a textured and patterned flooring and increases the flexibility of patterns that can be created in concrete. The generally larger dimensions of the imprint pattern mats also enables the design of larger scaled patterns, faster installation, and less impact on installer efforts. Depending on the design stamp on each of the imprint pattern mat used, the concrete may have a finalized pattern that is either random or symmetrical. In addition, the imprint pattern mat also eliminates potentially costly mistakes and inherent flaws caused by traditional patterned imprinting tools. For example, the overlapping feathered border of the thin flexible mats eliminates the formation of excess concrete between the stamps and the likelihood of the stamps shifting around when tamped into the concrete, using a joint roller to connect designs of adjacent pattern mats decreases unsightly handstamping and alignment issues, and utilizing snowshoe-like foot floats enables a much earlier start time, vastly reducing the risk of falling behind the hardening set of the concrete.

Although the present invention has been described with reference to preferred embodiments, workers skilled in the art will recognize that changes may be made in form and detail without departing from the spirit and scope of the invention.

The invention claimed is:

1. A method of creating a pattern in concrete comprising:

placing a first pattern mat in a first position, the first pattern mat including a bottom surface, a top surface, and a center portion surrounded by a feathered border, the bottom surface having a design stamp located within the center portion, the top surface having a first alignment mark at a junction of the feathered border and the center portion to indicate on the top surface the junction of the feathered border and the center portion which is otherwise not apparent by viewing the top surface;

aligning a second alignment mark of a second pattern mat with the first alignment mark of the first pattern mat, the second pattern mat including a bottom surface, a top surface, and a center portion surrounded by a feathered border, the bottom surface having a design stamp located within the center portion, the second alignment mark being located on the top surface at the junction of the feathered border and the center portion to indicate on the top surface the junction of the feathered border and the center portion which is otherwise not apparent from by viewing top surface, wherein alignment of the second alignment mark with the first alignment mark causes the feathered borders of the first and second pattern mats to overlap and the design stamps of the first and second pattern mats to align;

stamping the first pattern mat and second pattern mat into the concrete; and removing the first pattern mat and second pattern mat from the concrete.

2. The method of claim 1, wherein aligning the second alignment mark of the second pattern mat with the first alignment mark of the first pattern mat comprises overlapping a portion of the feathered border of the first pattern mat with a portion of the feathered border of the second pattern mat so that the first alignment mark overlaps the second alignment mark.

3. The method of claim 1, wherein the design stamp of the first pattern mat and the design stamp of the second pattern mat create an asymmetrical pattern in the concrete.

4. The method of claim 1, and further comprising aligning a third pattern mat with the second pattern mat and stamping the third pattern mat into the concrete, wherein the third pattern mat has a feathered border and a bottom surface with a design stamp.

5. The method of claim 1, wherein the first pattern mat and the second pattern mat are removed from the concrete using handles.

6. The method of claim 1, and further comprising connecting with at least one line a first design formed in the concrete by stamping the first pattern mat and a second design formed in the concrete by stamping the second pattern mat.

7. The method of claim 6, wherein connecting the first design formed in the concrete by stamping the first pattern mat and the second design formed in the concrete by stamping the second pattern mat comprises using at least one of a joint roller, a hand stamp chisel, and a grinder.

8. A method of creating a pattern in concrete, the method comprising:

placing a first pattern mat on the concrete, wherein the first pattern mat includes a center portion having corners, a bottom surface, and a top surface, the first pattern mat further including a feathered portion surrounding the corners of the center portion, wherein a design stamp is positioned within the corners of the center portion on the bottom surface, and a first alignment mark is positioned on the top surface at one of the corners to indicate a corner of the center portion which is not otherwise apparent by viewing the top surface;

aligning a second alignment mark on a second pattern mat with the first alignment mark, wherein the second pattern mat includes a center portion having corners, a bottom surface, and a top surface, the second pattern mat further including a feathered portion surrounding the corners of the center portion, wherein a design stamp is positioned within the corners of the center portion on the bottom surface, and the second alignment mark is positioned on the top surface at one of the corners to indicate a corner of the center portion which is not otherwise apparent by viewing the top surface, so that the feathered boarders overlap and the design stamps are aligned;

stamping the first pattern mat and second pattern mat into the concrete so that the design stamps located in the center of the bottom surfaces are imprinted into the concrete; and removing the first pattern mat and the second pattern mat from the concrete.

9. The method of claim 8, wherein aligning the second alignment mark of the second pattern mat with the first alignment mark of the first pattern mat comprises overlapping a part of the feathered portion of the first pattern mat with a part of the feathered portion of the second pattern mat so that the first alignment mark overlaps the second alignment mark.

10. The method of claim 8, and further comprising aligning a third alignment mark on a third pattern mat with the second alignment mark, wherein the third pattern mat includes a center portion defined at least three corners and having both a bottom surface and a top surface, a feathered portion surrounding the center portion, a design stamp located on the bottom surface, and the third alignment mark is located on the top surface at one of the at least three corners.

11. The method of claim 8, wherein the first pattern mat and the second pattern mat are removed from the concrete using handles.

12. The method of claim 11, wherein the handles are located adjacent the junction of the center portion and the feathered portion.

13. The method of claim 8, wherein the design stamp of the first pattern mat creates a first design pattern and the design stamp of the second pattern mat creates a second design pattern in the concrete that is spaced apart from the first design pattern.

14. The method of claim 8, and further comprising connecting at least one line from the first design pattern with at least one line from the second design pattern.

15. The method of claim 14, wherein connecting at least one line from the first design pattern with at least one line from the second design pattern comprises tooling a line across the concrete that was located below the feathered boarders.

16. A method of creating a pattern in concrete, the method comprising:

placing a first pattern mat on the concrete, wherein the first pattern mat includes a center portion having a plurality of corners, a bottom surface, and a top surface, the first pattern mat further including a feathered portion surrounding the center portion, wherein a design stamp is located on the bottom surface within the plurality of corners, and a first plurality of alignment marks, each alignment mark including lines on the top surface indicating the location of one of the plurality of corners thereby designating boundaries of the center portion which are not otherwise apparent by viewing the top surface;

aligning a second alignment mark on a second pattern mat with one of the first plurality of alignment marks from the first pattern mat, wherein the second pattern mat includes a center portion defined by a plurality of corners and having both a bottom surface and a top surface, a feathered portion surrounding the center portion, a design stamp located on the bottom surface within the plurality of corners, and a second plurality of second alignment marks located on the top surface and indicating location of the plurality of corners thereby designating boundaries of the center portion which are not otherwise apparent by viewing the top surface, so that the feathered boarders overlap and the design stamps are aligned;

stamping the first pattern mat and second pattern mat into the concrete so that the design stamps located in the center of the bottom surfaces are imprinted into the concrete while leaving the concrete beneath the feathered portions substantially designless;

removing the first pattern mat and the second pattern mat from the concrete to reveal the first design stamp, the second design stamp, and the substantially designless border extending between the first and second design stamps; and connecting a line created by the first design stamp with a line created by the design stamp by creating an impression in the substantially designless border.

* * * * *